United States Patent [19]

Fraioli

[11] 4,095,132

[45] June 13, 1978

[54] ELECTRON MULTIPLIER

[75] Inventor: Anthony V. Fraioli, Essex Fells, N.J.

[73] Assignee: Galileo Electro-Optics Corp., Sturbridge, Mass.

[21] Appl. No.: 395,801

[22] Filed: Sep. 11, 1964

[51] Int. Cl.[2] ..... H01J 43/00

[52] U.S. Cl. ..... 313/103 CM; 328/243; 250/207; 250/213 VT

[58] Field of Search ..... 313/103, 95, 44, 46, 313/30, 103 R, 103 CM; 330/42; 174/15, 110; 250/207, 213 VT; 328/243

[56] References Cited

U.S. PATENT DOCUMENTS

| | | | |
|---|---|---|---|
| 2,932,768 | 4/1960 | Wiley | 315/39.63 |
| 3,187,226 | 1/1965 | Kates | 361/387 |
| 3,227,905 | 1/1966 | Talcott | 313/39 |
| 3,243,628 | 3/1966 | Matheson | 313/103 R |
| 3,244,922 | 4/1966 | Wolfgang | 313/95 |

*Primary Examiner*—Maynard R. Wilbur
*Assistant Examiner*—T. M. Blum

EXEMPLARY CLAIM

1. An electron multiplier comprising wall means of secondary electron emissive material defining a spiral passage, means for providing a current flow through said wall means to supply electrons for secondary emission, a resistance means provided in said wall means and connected in parallel across a portion of the spiral passage defined by said wall means to provide more uniform current multiplication along said passage length.

9 Claims, 3 Drawing Figures

ELECTRON MULTIPLIER

This invention relates to a channel multiplier for multiplying electrons, and more particularly, to a novel support for the secondary electron emissive wall means of a channel multiplier.

The channel electron multiplier of the present invention is an improvement of the tube-type channel electron multiplier shown and described in U.S. Pat. No. 3,128,408 to Goodrich et al and assigned to the same assignee as the present invention. In this type of multiplier, a semi-conductive, secondary electron emissive film is formed on the inside surface of an electrically insulating tubular glass support. Upon the application of a voltage difference between the ends of the secondary electron emissive film, current flows therethrough to produce an electric field. Electrons entering the input end of the tube are accelerated through the tube by the electric field and are multiplied, through secondary emission, when they strike the secondary electron emissive film. The greater the current flow through the secondary electron emissive film, commonly referred to as strip current, the greater is the gain of the multiplier because the strip current supplies the electrons in the secondary emission process.

Current densities of up to $10^3$ amps/$cm_2$ are generated in the secondary electron emissive film of the Goodrich multiplier and this is accompanied by localized generation of excessive amounts of heat. The tubular glass wall supporting the secondary electron emissive film effectively wraps the emissive film in a thermal insulator. As a result, strip current and the gain of the multiplier must be limited to prevent thermal runaway and damage to the conductive film. In addition, the output from the Goodrich multiplier undergoes a drift as the strip seeks to attain thermal equilibrium.

The improvement of the present invention on the electron multiplier of the U.S. Pat. No. 3,128,408 to Goodrich et al is provided by a novel crystalline ceramic support for the secondary electron emissive film. The material, together with the novel structural design of the support, improve the gain and stability of the channel multiplier and allow for novel modifications, not hereinbefore feasible.

Due to its crystalline internal structure, the ceramic material employed in the support for the secondary emissive film in the present invention is a thermal conductor and as such, it readily dissipates heat generated as a result of an increase in strip current. In comparison, glass, as used in the Goodrich device, is an amorphous substance resulting in poor thermal conductivity. In addition, the ceramic material is capable of being molded, pressed or machined so as to form multiplying paths designed to minimize the heat generated and to control the magnitude and location of electron wall collisions. For example, the cross-sectional area of the multiplying path may be increased as the exit end is approached so as to increase the mass available as a heat sink at areas of dense electron multiplication. The multiplying path may be made to form a spiral so as to increase the number of electron wall collisions. The multiplier is also capable of being manufactured with means for shunting the secondary electron emissive film so as to provide more uniform current multiplication along the channel length.

An object of the present invention is to provide an electron multiplier having a very high gain and a minimum of drift.

Another object of the present invention is to provide a channel multiplier including a thermally conductive ceramic support for the secondary electron emissive film of the multiplier so as to readily dissipate heat generated in the film thereby preventing thermal runaway and damage to the film.

Another object of the present invention is to provide a channel electron multiplier using a minimum of secondary electron emissive material.

Another object of the present invention is to provide a channel electron multiplier having a structure which allows for flexibility in design.

Another object of the present invention is to provide a channel electron multiplier having a channel which defines a curving path to minimize feedback and increase electron wall collisions.

Another object of the present invention is to provide a channel electron multiplier having a shunted secondary electron emissive film to provide more uniform current multiplication along the channel length.

Another object is to provide a channel electron multiplier having a collector electrode mounted within the channel to provide greater collection efficiency.

Another object of the present invention is to provide a channel electron multiplier having a cross-sectional area which increases as the exit end of the multiplier is approached so as to increase the mass available as a heat sink at areas of dense electron multiplication.

Another object of the present invention is to provide a channel multiplier having connecting terminals fused therein.

Another object of the present invention is to provide a channel electron multiplier having a small, rugged, easily manufactured structure.

These and other objects and features of the invention are pointed out in the following description in terms of the embodiments thereof which are shown in the accompanying drawings. It is to be understood, however, that the drawings are for the purpose of illustration only and are not a definition of the limits of the invention, reference being had to the appended claims for this purpose.

IN THE DRAWINGS

Figure 1:
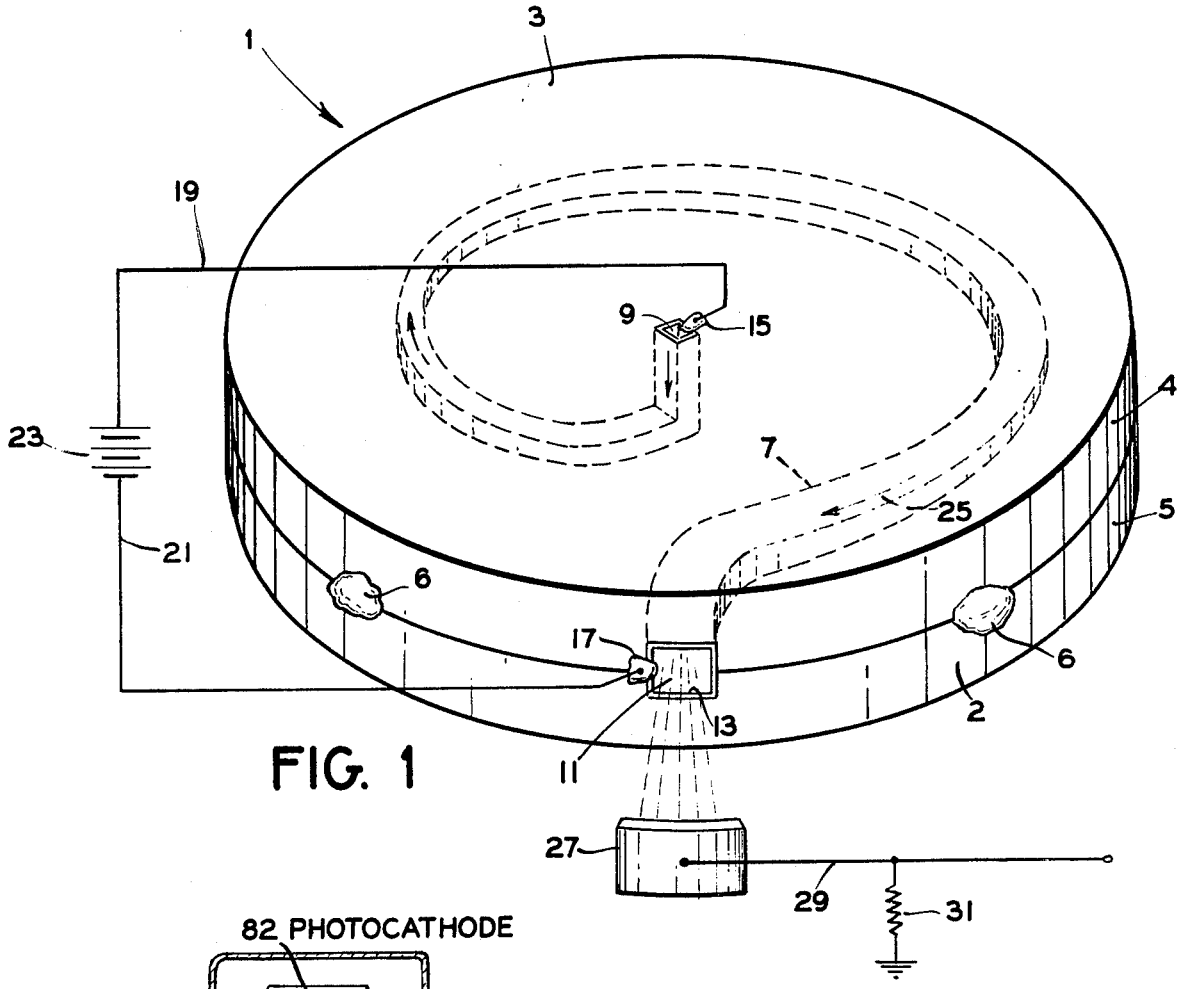
FIG. 1 is a perspective view of one embodiment of the present invention.

Referring to FIG. 1, an electronic multiplier constructed in accordance with the present invention is shown as comprising a cylindrical disc 1 having a side surface 2 and a top surface 3. Disc 1 is comprised of an upper disc 4 and a lower disc 5 secured together by glazing material applied in electrically isolated areas, as at area 6.

Discs 4 and 5 are made of an electrically insulating, thermally conductive ceramic material having a crystalline internal structure. Ceramic material such as alumna, beryllia, mullite, or steatite may be employed. Before firing, the ceramic is capable of being molded or pressed to meet any design requirements. After firing, the ceramic may be machined with dimensional tolerances closely controlled.

Disc 1 has a passage 7 extending therein. Passage 7 is formed by confronting equally dimensioned channels in the upper and lower discs 4 and 5. An entrance port 9 to passage 7 is centrally located in the top surface 3 and an exit port 11 is located midway between the upper and lower edges of the side surface 2. Passage 7 defines a spiral path which minimizes a feedback phenomena, hereinafter more fully described.

Entrance port 9 is adapted to be positioned to receive a beam of free electrons (or other energetic particles such as ionized molecular, atomic, or fission fragments) from a suitable source (not shown). As hereinafter more fully described, the multiplier may be used in a photomultiplier tube wherein the source should be an optically excited photocathode.

A conducting film 13 having a high resistance and secondary electron emissive properties is coated on all surfaces of entrance port 9, passage 7 and exit port 11. Film 13 may be made of a high lead oxide content glass, which glass, after hydrogen reduction, acquires semiconducting and secondary electron emissive properties. This glass may be composed of a mixture of 32 percent lead oxide, 61.3 percent silicon dioxide, 6.2 percent of barium carbonate and 0.5 percent of bisimuth trioxide.

Conventional channel multipliers require a much greater amount of secondary electron emissive material than the amount used in film 13 because in conventional multipliers the secondary electron emissive material is also utilized to provide structural strength.

One method of applying the conducting film 13 is to deposit the lead content glass as a glaze onto all of the surfaces of the channels of the upper and lower discs 4 and 5, prior to assembly. The glaze may be deposited as a wet frit which is then fired into the walls of the channels. Dimensional uniformity of the film 13 is gained by honing the glaze after it flows during firing or by successively applying very thin glaze coatings with each coating absorbed into the walls of the channel during firing. This second technique is preferred, since with a controlled substrate pore structure, the glaze thickness will be minimized and will be a function primarily of firing conditions.

Conductivity is developed in film 13 by hydrogen reduction. Film 13 is reduced by heating it from 325° to 500° C for 8 to 16 hours while flowing 1 liter per minute of pure hydrogen across its surface.

The cross-sectional area of passage 7 continuously increases as exit port 11 is approached. The terminal portion of passage 7 is the portion where most electron multiplication occurs and, as a result, the terminal portion is also the area where most heat is generated. The increased surface area in the terminal portion of passage 7 allows a greater amount of heat to be dissipated.

A conductive coating 15 such as silver paste is provided on top surface 3 in contact with film 13 at the entrance port 9 and a similar conductive coating 17 is provided on side surface 2 in contact with film 13 at exit port 11. Conductive coatings 15 and 17 provide connecting terminals for leads 19 and 21, respectively. A DC voltage source 23 is placed between the leads 19 and 21 to provide a voltage difference of 1000 to 2000 volts across the film 13 which produces a current flow through the film. This current flow results in a uniform electric field, indicated by arrow 25, extending substantially parallel to the surface of film 13.

A collector electrode 27, mounted adjacent exit port 11, is adapted to receive the electrons emerging from exit port 11. These electrons flow through conductor 29 and an output voltage is developed across load resistor 31.

OPERATION

A stream of free electrons enter entrance port 9 and are accelerated in the direction of exit port 11 by the uniform curving electric field 25 produced by the potential drop across film 13. The electrons will, after travelling a certain distance, strike the surface of film 13, thereby producing secondary emission of electrons. The secondary electrons thus produced, after being accelerated a certain distance toward the exit end, will also strike the film 13 to produce an increased number of secondary electrons. This action continues as the electrons travel toward exit port 11. Upon leaving exit port 11, the amplified electron current strikes collector electrode 27, flows through conductor 29 and develops an output voltage across load resistor 31.

The gain of a channel multiplier constructed in accordance with the present invention can be made much greater than heretofore achieved with conventional channel multipliers. The maximum gain is directly proportional to the magnitude of the strip current flowing through secondary electron emissive coating 13. A relatively large magnitude of strip current can flow through the secondary electron emissive coating 11 as compared to the magnitude of the strip current in conventional channel multipliers because the heat generated in the strip is readily dissipated by thermally conductive disc 1 thereby preventing excessive heating of the strip, minimizing drift, and preventing thermal runaway and damage to the film.

The curved or spiral passage 7 minimizes a feedback phenomena which has been ascribed as due to ionization of gas molecules or photon generation in the high space current density region in the vicinity of exit port 11 of the multiplier. The convoluting walls in spiral passage 17 limit feedback generation to a small section of spiral passage 7.

Figure 2:
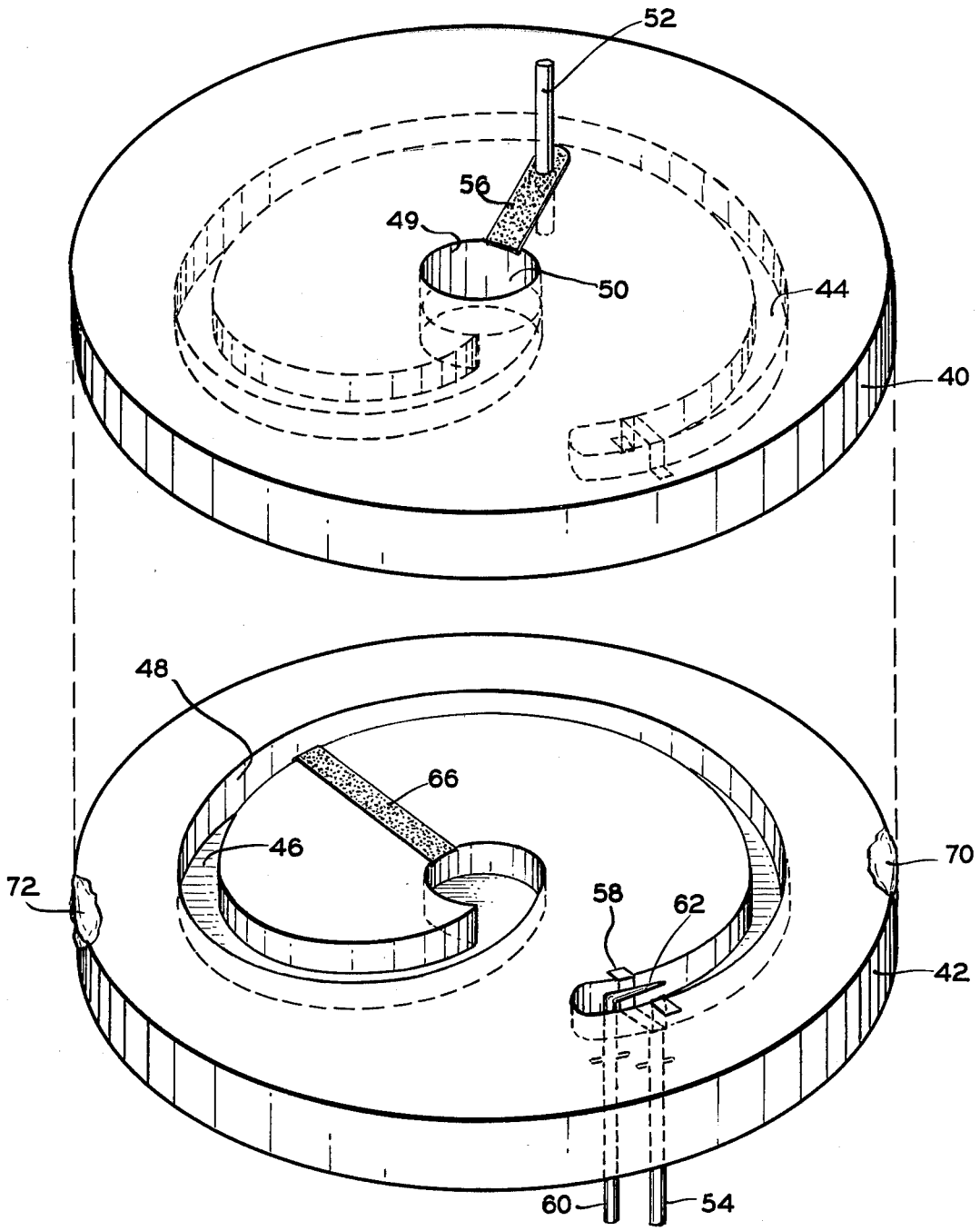
FIG. 2 is a perspective view of a second embodiment of the present invention, shown disassembled.

Referring to FIG. 2, a modified form of the present invention is shown, disassembled, comprising two cylindrical discs 40 and 42 made of the same crystalline ceramic material as disc 1, hereinbefore described. Disc 40 has a groove 44 formed in its bottom surface which is adapted to confront a groove 46 in the top surface of disc 42 so as to form a confined electron passage multiplication. The walls of grooves 44 and 46 are coated with a conducting film 48 having a high resistance and secondary emissive properties. Film 48 may be made of the same material as the secondary electron emissive film 13, hereinbefore described. Electrons to be multiplied are adapted to enter the confined path formed by grooves 44 and 46 through the entrance port 50 extending from the top surface of disc 40 to one end of electron multiplication passage. The wall of passage 50 is coated with a film 49 which contacts with, and is of the same material and thickness as, film 48.

Disc 40 is provided with a terminal pin 52 and disc 42 is provided with a terminal pin 54. A conductive coating 56 connects terminal pin 52 with the secondary electron emissive film 49 on the wall of entrance port 50. A metalized layer 58, which abuts and overlaps the terminal portion of secondary electron emissive film 48, electrically connects film 48 to terminal pin 54. A voltage difference of 1000 to 2000 volts is adapted to be connected between terminal pins 52 and 54 to produce a current flow through the secondary electron emissive film 48.

A collector electrode 60 is fused into disc 42 for collecting the multiplied electrons. The collector electrode 60 is provided with a needle-shaped end portion 62 which extends into the end of the multiplication region without making contact with the metallized layer 58 or the secondary electron emissive film 48. By mounting the collector electrode within disc 42 rather than in an external relation thereto, a more rugged and compact structure is provided. In addition, the collection efficiency is much greater due to the extremely high electric field existing near the tip of the pointed end portion 62.

A shunting resistance 66 is printed onto the top surface of disc 42 and connects the portion of secondary emissive film 48 adjacent entrance port 50 to an intermediate portion thereof. The resistance of the portion of the secondary emissive film 48 shunted by resistance 66 is thereby lowered and as a result, the electric field at the beginning of the path is of smaller magnitude than the electric field existing at the end of the path. This results in the electrons being initially accelerated at a slow rate along the electron passage multiplication and at a fast rate at the end of the electron multiplication passage. Normally, most electronic multiplication occurs at the end of the electron multiplication passage. By accelerating the electrons at a slower rate initially, more opportunity is given for multiplying wall collisions at the beginning of the electron multiplication passage thereby providing more uniform current multiplication along the channel length. For clarity, the shunting resistance 66 is shown contacting the emissive film 48 at a single location to provide a single break in the resistance profile of the channel. It is to be understood that the shunting resistance may have multipoint contact with emissive film 48 to provide more complete control of the channel field.

Solder glass or glazing material is applied in electrically isolated areas, as at 70 and 72, to seal disc 40 to disc 42 and to thereby completely box in the electron multiplication passage.

Figure 3:
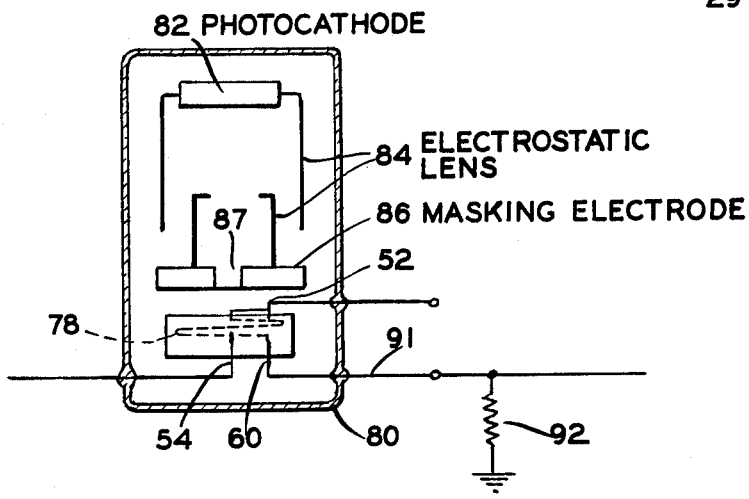
FIG. 3 is a schematic diagram of a star tracker photomultiplier tube using an electron multiplier constructed in accordance with the present invention.

Referring to FIG. 3, a schematic diagram of an image dissector photomultiplier tube incorporating an electron multiplier 78 constructed in accordance with the present invention is shown. The photomultiplier tube may be of the type shown and described in detail in U.S. application Ser. No. 385,878 by William R. Polye, for an IMAGE DISSECTOR PHOTOMULTIPLIER TUBE filed on July 29, 1964.

Briefly, the photomultiplier tube is comprised of an evacuated envelope 80 having supported therein a photocathode 82, an electrostatic lens 84, a masking electrode 86 having an aperture 87 and electron multiplier 78. Multiplier 78 is identical to the multiplier of FIG. 2, hereinbefore described, having a collector electrode 60 and terminal pins 52 and 54 embedded therein.

In operation, an optical system, not shown, images a portion of the sky upon photocathode 82. A photoimage of a star or other celestial body impinging on the outer surface of the photocathode 82 causes an electron stream to be emitted from the inner surface of the photocathode 82. Electrons passing through aperture 87 enter electron multiplier 78 which greatly amplifies the number of electrons. The amplified electrons are collected by the collector electrode 60 within the multiplier causing a proportional current flow through conductor 91 and producing an output voltage across load resistor 92.

The use of a multiplier constructed in accordance with the present invention in a star tracker photomultiplier tube greatly increases the structural rigidity of the tube because the collector and terminal pins to the multiplier are fused into the multiplier and not externally mounted as in conventional multipliers. In addition, the multiplier of the present invention greatly minimizes the tube height.

While two embodiments of the invention have been illustrated and described in detail, it is to be expressly understood that various changes in the form and relative arrangements of the parts, which will now appear to those skilled in the art, may be made without departing from the scope of the invention. Reference is, therefore, to be had to the appended claims for a definition of the limits of the invention.

What is claimed is:

1. An electron multiplier comprising wall means of secondary electron emissive material defining a spiral passage, means for providing a current flow through said wall means to supply electrons for secondary emission, a resistance means provided in said wall means and connected in parallel across a portion of the spiral passage defined by said wall means to provide more uniform current multiplication along said passage length.

2. An electron multiplier comprising wall means of secondary electron emissive material defining a spiral passage having an entrance port concentrically positioned in relation to said wall means and an exit port, means for providing a current flow through said wall means to supply electrons for secondary emission, said spiral passage increasing in cross-sectional area as said exit end of said spiral passage is approached so as to increase the mass available as a heat sink in areas of dense electron multiplication.

3. An electron multiplier as defined by claim 2, including support means for supporting said wall means, said support means comprising a crystalline ceramic material, and said spiral passage having an exit port opening radially from said support means.

4. An electron multiplier comprising wall means enclosing an electron multiplication passage, the inner surface of said wall means being coated with a film of secondary electron emissive material, means for providing a current flow through said film to supply electrons for secondary emission, a collector electrode fused into said wall means and including a needle-shaped end portion extending into said electron multiplication passage, said needle-shaped end portion providing a high electric field at the end portion thereof for collecting the output of said multiplier.

5. An electron multiplier comprising a wall means defining an electron multiplication passage curving through a substantial angle thereby minimizing feedback and increasing electron wall collisions, a collector electrode fused into said wall means for rigid support and including a needle-shaped end portion extending longitudinally in spaced relation to the wall means and into said multiplication region, said needle-shaped end portion providing a high electric field at the end portion thereof to receive the output from said multiplication passage with a maximum of efficiency.

6. An electron multiplier comprising a pair of cylindrical discs made of a thermally conducting, electrically insulating material, one of said discs having a first spiral groove on its top surface while the other of said discs has a second spiral groove on its bottom surface, a film of secondary electron emissive material coated on all the walls of at least one of said spiral grooves, means for securing said discs together with said spiral grooves in a confronting relation so as to define an electron multiplication passage of a spiral shape, means for providing a current flow through said film to provide electrons for secondary emission, one of said discs including an entrance passage concentrically positioned in relation to one of said spiral grooves and communicating with one end of said electron multiplication passage of said spiral shape, a collector electrode fused into one of said discs and including a needle-shaped end portion extending into said electron multiplication passage, said needle-shaped end portion providing a high electric field at the end portion thereof for collecting the output from said multiplication passage.

7. An electron multiplier comprising a pair of cylindrical discs made of a thermally conducting, electrically insulating material one of said discs having a first spiral groove on its top surface while the other of said discs has a second spiral groove on its bottom surface, each of said grooves defining a spiral path, a film of secondary electron emissive material coated on all walls of said grooves, means for securing said discs together with said grooves in a confronting relation defining an electron multiplication passage having a spiral shape, a terminal pin fused into each of said discs, a source of potential connected between said terminal pins, first conductor means connecting one of said terminal pins to said film adjacent one end of said spiral shaped electron multiplication passage, second conductor means connecting the other of said terminal pins to said film adjacent the other end of said spiral shaped electron multiplication passage, a collector electrode fused into one of said discs and including a needle-shaped end portion extending longitudinally in spaced relation to the walls of said grooves and into said electron multiplication passage, said needle-shaped end portion providing a high electric field of the end portion thereof for collecting the output from said electron multiplication passage.

8. The combination defined by claim 7 including an electrical resistance means provided in the surface of one of said discs and connected across the film of secondary electron emissive material coated on a portion of the spiral groove on said surface to provide a more uniform current multiplication along said spiral shaped electron multiplication passage.

9. The combination defined by claim 8 including an entrance passage concentrically positioned in one of said discs in relation to said spiral grooves and communicating with said one end of said spiral shaped electron multiplication passage.

* * * * *